US005459748A

United States Patent [19]

Gleichman et al.

[11] Patent Number: 5,459,748

[45] Date of Patent: Oct. 17, 1995

[54] APPARATUS AND METHOD FOR ELECTRICALLY HEATING A REFRACTORY LINED VESSEL BY DIRECTLY PASSING CURRENT THROUGTH AN ELECTRICALLY CONDUCTIVE REFRACTORY VIA A RESILIENT ELECTROTE ASSEMBLY

[75] Inventors: Robert C. Gleichman, Port Allen; Richard W. Wittman, Baton Rouge; Marvin E. Brumfield, Jr., Denham Springs, both of La.

[73] Assignee: The Dow Chemical Company, Midland, Mich.

[21] Appl. No.: 260,289

[22] Filed: Jun. 14, 1994

[51] Int. Cl.[6] ..... H05B 3/14; F27D 1/00

[52] U.S. Cl. ..... 373/132; 373/119; 373/137; 373/129; 219/541; 432/247

[58] Field of Search ..... 373/119, 132, 373/137, 30, 112, 122, 129, 130; 219/390, 541; 338/316; 432/251, 247, 252; 266/280; 392/441, 449–454, 416

[56] References Cited

U.S. PATENT DOCUMENTS

| | | | |
|---|---|---|---|
| 1,313,125 | 8/1919 | Shoeld | 373/127 |
| 1,313,985 | 8/1919 | Fitzpatrick et al. | 373/132 |
| 1,324,156 | 12/1919 | Jacoviello | 373/118 |
| 1,350,876 | 8/1920 | Mayer et al. | 373/119 |
| 3,439,104 | 4/1969 | Robinson | 373/137 |
| 3,823,003 | 7/1974 | Mulcihy | 373/119 |

FOREIGN PATENT DOCUMENTS

| | | | |
|---|---|---|---|
| 421495 | 2/1911 | France | 373/119 |
| 402599 | 12/1945 | Italy | 373/130 |
| 12837 | 11/1913 | United Kingdom | 373/119 |
| 411105 | 5/1934 | United Kingdom | 373/132 |

*Primary Examiner*—John A. Jeffery

[57] ABSTRACT

An apparatus and a method for electrically heating a refractory lined process vessel or reactor by directly passing current through an electrically conductive refractory lining using electrical heating assemblies incorporating a resilient, convoluted nickel conductor. When the heating assemblies are attached to the electrically conductive refractory lining, an impressed voltage causes current to flow between the heating assemblies causing the refractory lining to be heated resistively.

19 Claims, 3 Drawing Sheets

APPARATUS AND METHOD FOR ELECTRICALLY HEATING A REFRACTORY LINED VESSEL BY DIRECTLY PASSING CURRENT THROUGTH AN ELECTRICALLY CONDUCTIVE REFRACTORY VIA A RESILIENT ELECTROTE ASSEMBLY

BACKGROUND OF THE INVENTION

The present invention relates to a device and a method of using the device to heat up a chemical process vessel, such as a reactor, to control the temperature in a chemical process vessel or to maintain the temperature therein. Conventionally, chemical process reaction vessels which are used in thermal, usually exothermic processes, can be refractory lined and have been heated to operating temperature by passing preheated fuel gas through the reactor for a time sufficient to heat the refractory lining in the reactor. With this method, the heat transfer is inefficient, with only a small percentage of the heat energy from the preheated gas stream being transferred to the wall of the vessel. Electrical heating of the outer shell is another method of heating such a reactor. This may be accomplished by wrapping the outside of the vessel with an electrical jacket consisting of a series of high resistance heater coils. Still another conventional method of heating a chemical reactor is to wrap the outside of the reactor with a series of coils in a heating jacket to carry hot fluids thereby also relying on inefficient heat transfer mechanisms to supply the necessary heat.

All of the forgoing methods suffer from inefficiencies; including poor heat transfer, excessive cost, the need to provide reactors made from high temperature resistant metals and the requirement of having to purge an incompatible heating gas from the reactor prior to introducing the chemical reactants. U.S. Pat. No. 3,823,003 teaches the use of electrical heating of a vacuum furnace utilizing alternating current flowing along an outer steel shell of a reactor and then through a graphite brick lining back to the power source. This may lead to overheating of the outside of the metal reactor thereby posing a hazardous situation.

It is therefore one object of the present invention to provide an apparatus for heating a reactor that is efficient, safe and economical. It is another object of the present invention to provide an apparatus for heating a pressurized reactor, and it is still another objective to provide an apparatus that overcomes safety concerns associated with heating chemical reactors. A still further object is to provide a method for heating chemical process vessels utilizing the novel apparatus of the present invention.

BRIEF SUMMARY OF THE INVENTION

The present invention relates to an apparatus and a method for electrically heating a refractory lined reactor or other vessel by passing current through an electrically conductive lining via a resilient electrode assembly such as a sinusoidal wave form structure which is preferably made from Nickel 200.

In one embodiment the present invention relates to an apparatus for heating the refractory lining of a chemical reactor or chemical reaction process vessel by use of applying electrical current to the refractory itself through a novel, chemical and heat resistant heating assembly which penetrates the vessel wall. The heating assembly includes an interface connection apparatus. The interface connection apparatus may be enclosed in a housing which opens into the chemical reactor via an American National Standards Institute (ANSI) vessel flange and the novel heating assembly is adaptable to the reactor in the ANSI standard flange. The exterior connection outside the ANSI standard flange is interfaced to the insulated electrical cables by a standard National Electrical Manufacturers Association (NEMA) electrical lug. The power source cable is connected to an outer interface connector which is insulated from and penetrates a hole in the housing in a manner allowing the reactor to maintain pressure and temperature. The outer interface connector is resiliently connected to an inner interface connector which is in turn attached to the refractory lining. All of these connections are accomplished so that electrical conductivity is assured and so that the reactor shell or vessel wall and heating assembly housing are insulated from electrical contact. In order to effectively and efficiently heat the reactor using direct electrical resistance heating of the refractory, a plurality of heating assemblies is employed at various spaced locations about the reactor. In a preferred embodiment, the current is transmitted via appropriate conductors through the flange cover by an outer interface conductor that is both pressure sealed and electrically insulated from the reactor shell and the ANSI standard flange. In another preferred embodiment, up to 2,000 amps or more of direct current are transmitted via the heating assembly of the present invention into the refractory lining of the chemical reactor from a source of D.C. power. While a preferred embodiment for a particular application has used 2,000 amps of DC current, the amount of power which can be used is directly related to associated equipment, e.g., rectifiers and switch gear, to the design used in the housing, conductors and other equipment employed, and to the needs of the process.

In still another preferred embodiment, the inner interface connector is attached to a nonmetallic transition connector which is attached to the refractory lining of the chemical reactor. In a still further embodiment of the present invention, the outer interface connector is attached by means of a copper connector, then through an electrically insulated nickel outer interface connector which is then connected to a resilient conductor that provides for linear expansion in both vertical and horizontal directions of the refractory lining as the reactor heats up to operating temperature. This flexibility of the resilient conductor is necessary in order that the resilient conductor may move in relation to any expansion or linear growth of the refractory liner of the chemical reactor during heating or operating.

DETAILED DESCRIPTION OF THE PREFERRED EMBODIMENTS

Figure 1:
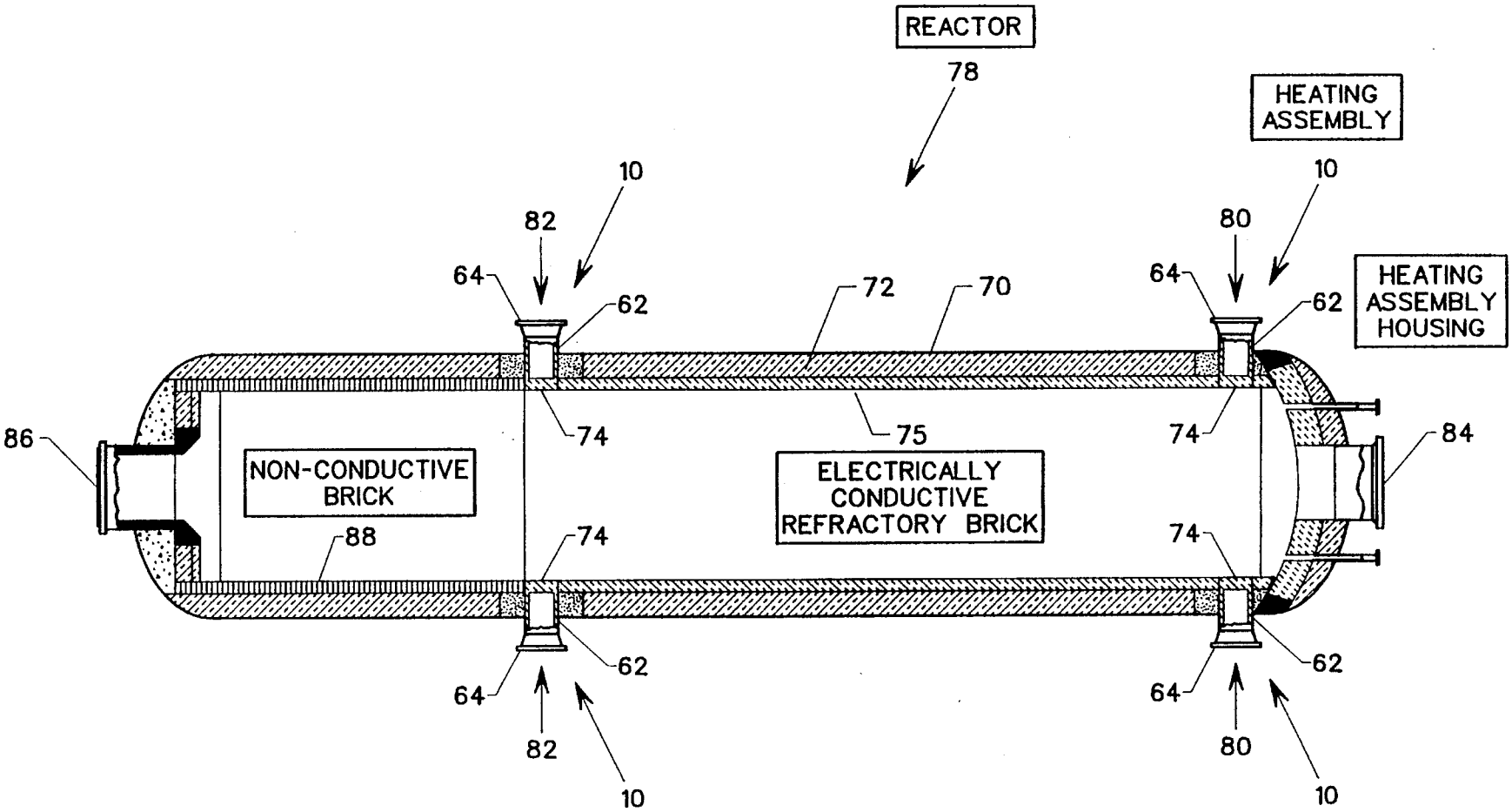
FIG. 1 is a pictorial partial cross-sectional view of a chemical reaction vessel which can employ the heating assembly of this invention, showing the various locations of the heating assemblies about the reactor in one preferred embodiment.

The present invention as shown in the previously described figures which gives satisfaction in service features an electrical heating assembly for a refractory lined chemical reactor, or other vessel which requires heating for whatever purpose. Such heating assembly is carried in a housing which penetrates the reactor or vessel shell which is usually of metal. The housing can likewise be thermally and electrically insulated from the metal vessel wall and can be pressure sealed, if required by the nature of the chemical process or vessel purpose. Preferably, the housing is a cylindrical standard flange which conventionally ends in a rim to which other pipe, equipment or sealing flange can be attached by means of conventional bolts or other means.

Within the housing, the various connecting means by which electrical current is brought from a power source to the conductive refractory lining of the reactor or vessel are insulated thermally and electrically from the housing and from the metal reactor shell. This is accomplished by having an outer interface connector, which is in a generally cylindrical form and is connected to the power source connector, pierce a sealing blind flange through a suitable hole or orifice centrally located in the sealing flange or plate. Preferably, the outer interface connector has a first end which is interior of the housing and a second end which extends beyond the sealing flange of the housing. The first end of the outer interface connector has head with a shoulder which abuts the blind flange inside the housing and with appropriate tensioning means and gasketing provides thermal and electrical insulation, as well as pressure seal, when specified, for the housing. Additionally, an insulating sleeve is placed over the shank of the outer interface connector and serves to isolate the edge of the orifice of the sealing plate. The tensioning means which can be used to complete the reactor or vessel pressure seal for the housing features a combination of jacking plate and jacking bolts which are urged outwardly from the housing by regularly spaced apart bolts about the face of the blind flange. A retaining plate which is attached to the outwardly extending shank of the outer interface connector by conventional means, such as threaded contact using a conventional pipe thread on the shank and the interior of the central hole in the retaining plate. The outward turning of the jacking bolts urges the jacking plate tightly against the retaining plate which is held in place by the threads on the shank of the outer interface connector and applies sealing pressure to the shoulder of the head of the first end of the outer interface connector whereby the housing is pressure sealed using the gasket in place between the shoulder and the blind flange. The electrical insulation is completed by placing an insulating ring between the jacking plate and the retainer plate.

The first end of the outer interface connector is permanently attached to one end of a resilient conductor. Any type of resilient conductor can be used which is self supporting, allows expansion in all directions and conducts electricity efficiently. Primarily, the resilient conductor is of a metal, and preferably, copper, nickel or similarly efficient conductive material. Several types of structural configurations for such conductors can be mentioned, such as, helical coil, sinusoidal wave form, bellows configuration, and the like. Non-self supporting conductors can be used if insulated support structures are employed. The other end of the resilient conductor is attached to an inner interface connector, which is employed to connect the resilient conductor to a transition connector. The inner interface connector has a first end which is generally cylindrical and has connecting means, usually in the form of threaded means to attach to the transition connector and a second end in the shape of a flat circular plate so as to form a plug for inserting into the transition connector. The resilient conductor is attached permanently to the second end of the inner interface connector, for example, by screwed connection, welding, J-lug connection and the like.

The transition connector can be generally round and cylindrical in shape having a first end which is tapered and has a connection means to a conductive nonmetallic refractory block and a second end which is connected to the inner interface connector. The second end can have an opening which receives the inner interface connector and can be attached thereto by the connection means, such as threaded connectors which provided secure and electrically contacting connection. Preferably, the transition connector is of a nonmetallic material and more preferably is composed of a material which is equivalent to the conductive refractory lining in thermal expansion and thermal insulating properties. A preferred material is also highly electrically conductive and, thus, one of the preferred materials for the transition connector is graphite. Other conductive refractory materials which are suitable include carbon brick, silicon carbide, aluminum nitride and the like.

The transition connector is so-called because it makes the transition from a metallic conductor which is used to this point in the circuit from the power source to the non-metallic conductive refractory which lines the chemical reactor or vessel. This transition is very important because of the different thermal and electrical characteristics of metallic and non-metallic conductors. Accordingly, the connection between the inner interface conductor and the transition connector is extremely important from an operating standpoint. Likewise the connection between the transition connector and the conductive refractory block is important because this is where resistive heating begins. The first end of the transition connector which is tapered can have a wide spaced apart thread which mates with a similar thread size in the conductive refractory block in much the same manner as a broom handle thread. This is effective because the non-metallic nature of the transition connector and the conductive refractory block do not allow complex or precise machining or thread cutting. Therefore, the present invention allows any method of interlocking the transition connector and conductive refractory, preferably graphite, block which will promote efficient and effective thermal and electrical conductivity.

The refractory conductive block is then applied to the inside of the reactor or vessel wall, usually by the standard techniques of mortar bricking in a stacked array or lattice work design sufficient to radiate thermal energy from the resistive heating of the electrical current passed through the refractory blocks. Preferably, the mortar used to hold the refractory in place is a conductive mortar, more preferably it is a silicate mortar and most preferable is a graphite silicate mortar. In practice and to have the resistive heating cover as much of the reactor wall surface as possible, an upper heating assembly is used as one electrode adjacent the top of the reactor and a lower heating assembly is used as a second electrode with the current passing through the conductive refractory between. There can be envisioned that more than one heating assembly can be used in both upper and lower reactor regions so that the current and voltage required to obtain efficient resistive heating is not unduly high or uneconomical. For example, up to three heating assemblies may be placed in a ring about the upper region of the reactor and up to three heating assemblies may be arranged in spaced apart relation in the lower region of the reactor or vessel. In each case there may be areas above and below the heating assemblies which are not resistively heated and therefore do not require conductive refractory blocks. In such non-heated regions only structural integrity and resistance to the reaction environment are required to maintain the refractory block in position. Typically, such non-heated regions employ insulating refractory, such as alumina brick.

In a preferred embodiment, the refractory lining may have a second type of insulating refractory between the conductive refractory and the reactor or vessel wall in order to keep the metallic reactor or vessel shell from becoming electrically charged and to prevent thermal losses to the atmosphere.

In a preferred embodiment of the present invention, there is provided an electrical heating assembly for preheating or controlling the temperature of the refractory lining of a refractory lined chemical process vessel from ambient temperature up to a desired or operating temperature for operation of a chemical process.

The heating assembly comprises a housing having a distal end and a proximal end with the distal end having an outer interface connecting means connected at one end to a resilient conductor and at the other end to a powder source connector. The housing is attached to and penetrates a reactor wall while the outer interface connecting means sealably and insulatingly penetrates the housing. The resilient conductor is also connected to an inner interface connecting means and electrically to a transition converter, with the transition converter being connected to an electrically conductive refractory block. This refractory block, electrically insulated from the reactor wall, is in electrically conductive contact with other refractory blocks such that when another heating assembly is attached to another refractory block, spaced apart from the first, an impressed voltage causes current to flow between the heating assemblies and the refractory blocks to be heated resistively. More preferably, the housing is a cylindrical structure and still more preferably the cylindrical structure terminates in a seal plate having a central orifice. A most preferred seal plate is a blind flange. Preferably, the outer interface connecting means is a generally cylindrical conductor having an open distal end and a proximal end which has a head and shoulder in abutting relation with the orifice of said seal plate and a shank extending through said orifice. More preferably, the outer interface connecting means has a distal end and a proximal end, the distal end having an opening to receive one end of a power source connector and the proximal end being connected to the resilient conductor. In a preferred feature, the head of the outer interface connecting means is permanently affixed to the resilient conductor, for example, as by welding. The resilient conductor has a structure selected from the group consisting of helical coil, sinusoidal wave form, laminated and bellows construction.

Figure 2:
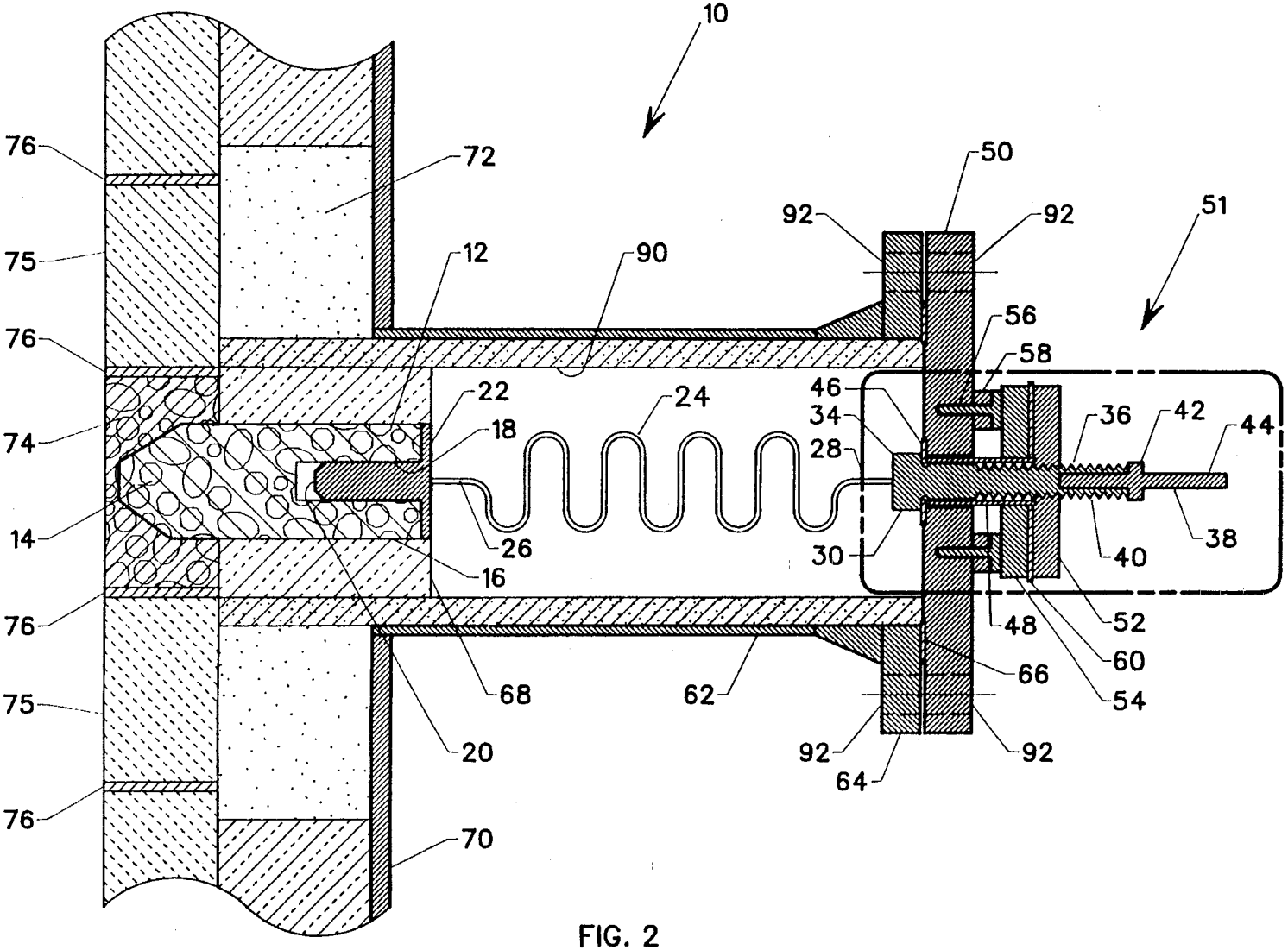
FIG. 2 is a schematic cross-sectional view of the heating assembly of this invention which is useful as an electrically insulated pressure sealed wall penetration assembly, shown in the housing and with reference to the interrelations to the refractory lining of a chemical reactor in which the heating assembly of this invention is used.

The present invention will be more easily understood and illustrated by reference to the Figures of the drawings. Particularly, as shown in FIG. 2, the heating assembly, generally indicated at 10, is shown from an outside pictorial view on FIG. 1 as it is installed in the outer side wall 70 of a chemical reactor 78 or vessel which is lined with refractory material. As seen in FIG. 1 several heating assemblies, 10, either upper heating assemblies 80 or lower heating assemblies 82, are disposed about the reactor 78 in an approximation of an upper ring and a lower ring in spaced apart relation approximately equidistant from each other in either the upper or lower ring. Each of the upper heating assemblies 80 is connected to a source of electrical power (not shown) for D.C. current and each of the lower heating assemblies 82 is connected to the other side of the D.C. power source so that with the conductive carbon brick refractory 75 between the upper and lower heating assemblies 80, 82 a complete electrical circuit is formed.

Illustratively, for a chemical reactor 78 having a length of 30 to 50 feet (9.14–15.24 meters) for reaction, that is, heated area which is subject to preheating using the heating assembly 10 of this invention, a current of up to 2000 amps and from 10–15 volts is required in order to resistively preheat the reactor to a temperature near the operating temperature of the chemical reaction, for example, up to about 500° C. The time to preheat the reactor to this temperature at this current level will range from 24 to about 48 hours. Of course, higher or lower temperatures can be obtained by using higher or lower current levels or, as one of skill in the art will understand, the time to reach a given temperature will vary with the amount of current used.

As shown in more detail in FIG. 2, the heating assembly of this invention, generally shown at 10, is contained within a housing 62 which can be of any convenient geometric form, but is preferably in a cylindrical housing ending in a flange 64. The heating assembly housing is preferably a standard ANSI flange opening which can conveniently be welded to an opening in reactor vessel wall 70. Usually supporting structure, such as reinforcing rings or supports are attached at the junction of the vessel wall 70 and the heating assembly housing 62, but it is not necessary for the proper function of the present invention. Also, usually an insulating liner 90 composed of an electrically and thermally insulating material is placed in the the housing 62 to prevent thermal losses and prevent the reactor 78 from becoming a part of the electrical circuit. The housing 62 is sealed by a blind flange 50 having a centrally located hole 53 and retained in place by appropriately spaced bolt holes 92 and bolts and nuts (not shown).

Figure 3:
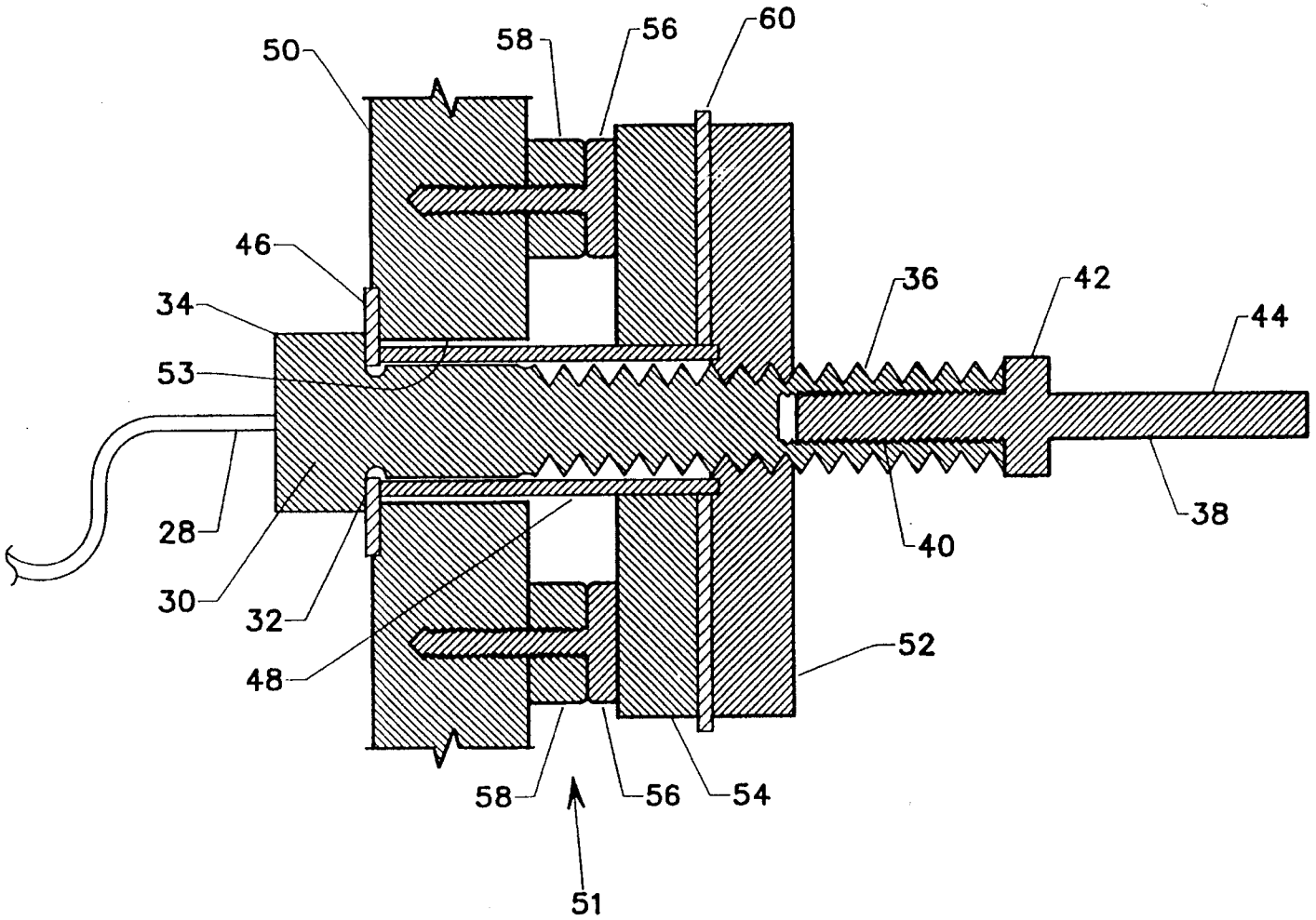
FIG. 3 is a detailed schematic cross sectional view of the housing flange penetrating, electrically insulated power source connection assembly shown in FIG. 2.

As more clearly shown in FIG. 3, the central hole 53 allows the outer interface connecting means 30 to extend through the blind flange 50 and connect with a suitable power source connector 38 which has its other end connected to a source of direct current (or alternating current, as desired). The outer interface connecting means 30 is generally a cylindrical metallic conductor which has a first end 34 of larger dimension than the central hole 53 in the blind flange 50 to form a head and a shoulder 32 in abutting relation to the blind flange 50. Outer interface connecting means 30 has a second end 36 which has an open end for receiving the threaded end 40 of power source connector 38, enabling the power source connector to be screwed into the outer interface connecting means 30 up to a stop shoulder 42. The remaining shank 44 of power source connector 38 can then be attached to a power source cable (not shown) by conventional means. The outer interface connecting means second end 36 and power source connector 38 should have their exposed portions insulated to prevent shock hazards.

The outer interface connecting means 30 is held in place and seals off the environment outside reaction vessel 78 using tensioning means 51. In order to obtain a seal between the shoulder 32 of outer interface connecting means 30 and blind flange 50 the outer interface connecting means shoulder 32 must be urged against the blind flange 50 in a manner which can be releasably accomplished so that the heating assembly can be easily changed or serviced when the reactor 78 is out of service. Tensioning means 51 includes jacking plate 54 which has a central hole and fits over the second end 36 of outer interface connecting means 30. It is urged against a retainer plate 52 which also has a central hole and fits over the second end 36 of outer interface connecting means 30, but is releasably and adjustably attached to the second end 36 of outer interface connecting means 30, preferably by threads on the outside of second end 36 and the inside of the central hole of retainer plate 52. Thus, using jacking bolts 56 evenly disposed about blind flange 50 and underneath the periphery of jacking plate 54, the jacking plate 54 can be urged against retainer plate 52 and because of the attachment to outer interface connecting means 30 the shoulder 32 is urged against blind flange 50 sealing the interior space of the reactor 78 from the surrounding environment and allowing pressurized operation of the reactor 78. Additional sealing effect is obtained by the interposition of an insulating gasket 46 between shoulder 32 and blind flange 50. Likewise, thermal and electrical insulation can be obtained between the outer interface connecting means 30 and the blind flange 50 by means of an insulating sleeve 48 about the outer interface connecting means 30 from shoulder 32 to the attached retainer plate 52. Likewise an insulating ring 60 is placed between jacking plate 54 and retainer plate 52 to prevent electrical connection between the source of electrical power and the reactor shell 70 and prevent it from becoming part of the electrical circuit. Also, retainer plate 52 can be covered with insulation to prevent shock hazard.

Referring again to FIG. 2, the first end 34 of outer interface connecting means 30 is permanently affixed to a resilient conductor 24. The resilient conductor 24 allows for independent movement of the electrical components without breaking electrical contact. As the refractory in the reactor heats, it expands and certain of the electrical components must move with the refractory or break electrical contact just as preheat begins. It has been found that a resilient conductor featuring a non-supported or self supporting structure provides this feature. Preferably, the resilient conductor is a metallic conductor and has the structural shape of a helical coil, a sinusoidal waveform, a laminated plate or a bellows construction, although other configurations can be envisioned and are a part of this invention. More preferable is the sinusoidal waveform and most preferable is that which is produced from Nickel 200 alloy which is 99.96 percent by weight nickel. As this material is heated through resistive heating it can expand and can move with the expanding refractory material in any direction.

At its other end, resilient conductor 24 is attached to the inner interface connecting means 18 which is used to connect to a transition connector 12 of a nonmetallic material. The inner interface connecting means 18 has a first end 20 which is receivable in the transition connector and a second end 22 which is a flat head and, thus, the inner interface connecting means 18 resemble a plug which is releasably connected to the transition connector 12, such as by threaded connection.

The transition connector 12 is of a nonmetallic, conducting material, similar to the conductive refractory, and preferably of graphite. The transition connector 12 has a tapered first end 14 and an opening in its second end 16 which is adapted to receive the inner interface connecting means 18. The tapered first end 14 can have releasable connecting means, such as wide spaced apart threads, adaptable to be fitted to corresponding threads in a tapered opening of a conductive graphite block 74, for example like a broomstick thread.

Transition connector 12 is primarily supported and held in place by the conductive refractory block 74, but insulating packing 68 can also be used to support the transition connector 12 and insulate the housing from thermal losses from the reactor. A suitable material is an alumina-silica ceramic fiber shaped in the form of discs having a central hole for the transition connector 12. Other ceramic materials can likewise be employed in this invention. Preferred is Kaowool™ alumina-silica ceramic insulating material from Babcock & Wilcox, Inc. In the upper heating assembly 80, the transition connector 12 and the associated components must be offset below the centerline of the housing 62 by as much as 1 inch (2.54 cm) to accommodate the upward expansion of almost 2 inches (5.08 cm) of the refractory brick in a 40 foot (12.19 meters) high brick reaction zone. The conductive refractory 75 is preferably a carbon brick and more preferably a graphite brick of similar composition to the refractory brick 74. A conductive graphite mortar 76, preferably a graphite-silicate mortar which is conductive, such as Vitrex C™ conductive graphite-silicate mortar produced by Atlas Minerals and Chemicals Division, Electric Storage Battery Co., is useful to maintain the refractory brick in position.

Between the conductive refractory brick 75 and the reactor vessel wall 70 is interposed a layer of non-conductive and thermally insulating refractory material 72. Suitable material may include foamed glass or silica bricks which are used to electrically and thermally insulate the conductive refractory brick 75 from the reactor wall 70. A preferred thermally insulating refractory brick 72 is Foamglas® cellular glass insulation manufactured by Pittsburgh Corning Company of Pittsburgh, Pa. Another preferred thermally insulating material is THERMO-SIL® FOAM 50 fused silica insulating block, manufactured by Ceradyne Thermo Materials of Scottdale, Ga., which is preferably located next to the heating assemblies 10. Different types of refractory may be employed near the heating assembly because of the hotter localized heating, e.g., THERMO-SIL® FOAM 50 at the inlet surrounding the heating assemblies 10 and Foamglas® at the rest of the reactor. Above or below the heated area of conductive refractory brick 75, it is not necessary to have conductive brick and a non-conductive, insulating refractory brick 88 can be employed, of which alumina brick is typical.

Another aspect of this invention is a method of preheating chemical reaction vessels prior to start of operations of an exothermic reaction so that the reactor can be heated from ambient conditions to the temperature at which the exothermic reaction can be initiated and maintained during operation. Preferably, there is provided a chemical reaction vessel having at least two heating assemblies as described hereinabove which are switched to the on position for reactor preheat of about 2000 amps and 10–15 volts and left until the temperature reaches that desired. Then the heating assemblies are switched off and the reactor feed is allowed to enter the feed inlet and upon contacting the hot environment of the reactor the desired reaction occurs and the products and byproducts, if any, are allowed to leave via the crude product outlet. Typical examples of such processes are carried out in thermal chlorinators which produce methyl chloride, methylene chloride, trichloromethane, perchloroethylene, trichloroethylene, allyl chloride and the like.

Having described the present invention illustratively, one skilled in the art would be readily aware of alternatives and equivalents of the components involved in the present invention. Therefore, it is desired that the invention be limited only by the lawful scope of the following claims.

What is claimed is:

1. An electrical heating assembly for preheating or controlling the temperature of the refractory lining of a refractory lined chemical process vessel from ambient temperature up to a desired or operating temperature for operation of a chemical process, said heating assembly comprising in combination:

a) a housing attached to and penetrating at least one wall of said reactor and having a distal end and a proximal end from said reactor wall;

b) said distal end of said housing having an outer interface connecting means sealably and insulatingly penetrating said housing and said outer interface connecting means having a first end connected to a resilient conductor and a second end connected to a power source connector;

c) said resilient conductor being connected at its other end to the second end of an inner interface connecting means and at its first end electrically attached to a transition connector;

d) said transition connector being connected at its first end to a electrically conductive refractory block;

e) said electrically conductive refractory block being electrically insulated from and spaced apart from said reactor vessel wall and in conductive contact with a plurality of similar electrically conductive refractory blocks, whereby when another heating assembly is attached to a spaced apart electrically conductive refractory block, an impressed voltage causes current to flow between said heating assemblies and said electrically conductive refractory block therebetween to be heated resistively.

2. The assembly of claim 1 wherein said housing is a cylindrical structure.

3. The assembly of claim 2 wherein said structure terminates in a seal plate having a central orifice.

4. The assembly of claim 3 wherein said seal plate is a blind flange.

5. The assembly of claim 3 wherein said outer interface connecting means is a generally cylindrical conductor having an open distal end and a proximal end which has a head and shoulder in abutting relation with the orifice of said seal plate and a shank extending through said orifice.

6. The assembly of claim 5 wherein said outer interface connecting means is insulated electrically from said housing and said seal plate by insulating means.

7. The assembly of claim 5 wherein said outer interface connecting means has a distal end and a proximal end, said distal end having an opening to receive one end of a power source connector and said proximal end being connected to said resilient conductor.

8. The assembly of claim 7 wherein said head of said outer interface connecting means is permanently affixed to said resilient conductor.

9. The assembly of claim 7 wherein said head of said outer interface connecting means is welded to said resilient conductor.

10. The assembly of claim 7 wherein said resilient conductor has a sinusoidal wave form structure.

11. The assembly of claim 10 wherein said resilient conductor is composed of Nickel 200.

12. The assembly of claim 1 wherein said inner interface connecting means is in the shape of a solid metallic plug having a shank containing a connecting means and a flat head transverse to the major axis of said shank.

13. The assembly of claim 12 wherein said shank of said inner interface connecting means supports a threaded connecting means.

14. The assembly of claim 1 wherein said transition connector is cylindrical in shape and has a receiving end for said connecting means of said inner interface connector and, at the end opposed to said receiving means for said inner interface connector, a tapered attachment means for attachment to a electrically conductive refractory block.

15. The assembly of claim 14 wherein said attachment means is complementary wide, relatively spaced apart threads on said tapered attachment means and on said electrically conductive refractory block.

16. The assembly of claim 14 wherein said electrically conductive refractory block attached to said transition connector is composed of conductive graphite material.

17. The assembly of claim 14 wherein said electrically conductive refractory block is composed of a conductive graphite material.

18. The assembly of claim 1 wherein said housing is a cylindrical structure terminating in a seal plate having a central orifice, said outer interface connecting means is a generally cylindrical conductor having an open distal end and a proximal end which has a head and shoulder in abutting relation with the orifice of said seal plate and a shank extending through said orifice and insulated electrically from said housing and said seal plate by insulating means, said head of said outer interface connecting means is permanently affixed to said resilient conductor having a sinusoidal waveform structure and being composed of Nickel 200, said inner interface connecting means is in the shape of a solid metallic plug having a shank containing a connecting means and a flat head transverse to the major axis of said shank, said transition connector is cylindrical in shape and has a receiving end for said connecting means of said inner interface connector and, at the end opposed to said receiving means for said inner interface connector, a tapered attachment means for attachment to a refractory block, both said transition connector and said refractory block being composed of conductive graphite material.

19. A method for preheating a refractory lined chemical reaction vessel which comprises provision of said vessel with at least two heating assemblies of claim 1, connecting said assemblies to opposite poles of a source of direct current electrical power, activating said power for a sufficient time to allow the refractory lining to attain the desired temperature and then deactivating said power and turning on the feed stream for said reaction vessel to begin operating the process for said vessel.

* * * * *